US010910147B2

(12) United States Patent
Yamamoto et al.

(10) Patent No.: US 10,910,147 B2
(45) Date of Patent: Feb. 2, 2021

(54) REACTOR AND METHOD FOR MANUFACTURING REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Shinichiro Yamamoto, Mie (JP); Takashi Misaki, Mie (JP); Seiji Shitama, Mie (JP); Tatsuo Hirabayashi, Mie (JP)

(73) Assignees: AutoNetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 255 days.

(21) Appl. No.: 16/301,098

(22) PCT Filed: May 23, 2017

(86) PCT No.: PCT/JP2017/019263

§ 371 (c)(1),
(2) Date: Nov. 13, 2018

(87) PCT Pub. No.: WO2017/204227

PCT Pub. Date: Nov. 30, 2017

(65) Prior Publication Data

US 2019/0189339 A1 Jun. 20, 2019

(30) Foreign Application Priority Data

May 25, 2016 (JP) ..... 2016-104714

(51) Int. Cl.
*H01F 27/32* (2006.01)
*H01F 37/00* (2006.01)
(Continued)

(52) U.S. Cl.
CPC ..... *H01F 27/32* (2013.01); *H01F 3/14* (2013.01); *H01F 27/022* (2013.01);
(Continued)

(58) Field of Classification Search
CPC .... H01F 27/022; H01F 27/263; H01F 27/292; H01F 27/306; H01F 27/32; H01F 3/14; H01F 37/00
(Continued)

(56) References Cited

U.S. PATENT DOCUMENTS 7,129,810 B1 10/2006 Kimura
2012/0092120 A1 4/2012 Yoshikawa et al.
(Continued)

OTHER PUBLICATIONS

International Search Report, Application No. PCT/JP2017/019263 dated Aug. 8, 2017.

*Primary Examiner* — Tszfung J Chan
(74) *Attorney, Agent, or Firm* — Honigman LLP

(57) ABSTRACT

A reactor including: a coil including a winding portion formed by winding a winding wire; and a magnetic core that forms a closed magnetic circuit constituted by an inner core portion located inside the winding portion and an outer core portion located outside the winding portion. The reactor further includes an inner resin portion that fills a gap between the inner circumferential surface of the winding portion and the outer circumferential surface of the inner core portion, and when a side, of the outer core portion, that faces the inner core portion is defined as an inner side, and the opposite side is defined as an outer side, the outer core portion is provided with a through hole that is open to both the inner side and the outer side, and the through hole is filled with a portion of the inner resin portion.

13 Claims, 4 Drawing Sheets

(51) Int. Cl.

| | |
|---|---|
| ***H01F 41/00*** | (2006.01) |
| ***H01F 3/14*** | (2006.01) |
| ***H01F 27/02*** | (2006.01) |
| ***H01F 27/26*** | (2006.01) |
| ***H01F 27/29*** | (2006.01) |
| ***H01F 27/30*** | (2006.01) |
| *H01F 27/255* | (2006.01) |

(52) U.S. Cl.
CPC ..... *H01F 27/263* (2013.01); *H01F 27/292* (2013.01); *H01F 27/306* (2013.01); *H01F 37/00* (2013.01); *H01F 41/005* (2013.01); *H01F 27/255* (2013.01)

(58) Field of Classification Search
USPC ..... 336/83, 90, 92, 96, 98, 198, 200, 232
See application file for complete search history.

(56) References Cited

U.S. PATENT DOCUMENTS

| | | | | |
|---|---|---|---|---|
| 2012/0126928 | A1 | 5/2012 | Yoshikawa et al. | |
| 2012/0154093 | A1* | 6/2012 | Yoshikawa ..... | H01F 37/00 336/180 |
| 2013/0181801 | A1 | 7/2013 | Yoshikawa et al. | |
| 2014/0125308 | A1 | 5/2014 | Yoshikawa et al. | |

* cited by examiner

REACTOR AND METHOD FOR MANUFACTURING REACTOR

CROSS-REFERENCE TO RELATED APPLICATIONS

This application is the U.S. national stage of PCT/JP2017/019263 filed May 23, 2017, which claims priority of Japanese Patent Application No. JP 2016-104714 filed May 25, 2016.

TECHNICAL FIELD

The present disclosure relates to a reactor and a method for manufacturing a reactor.

BACKGROUND

For example, JP 2014-003125A discloses a rector including: a coil that includes a winding portion formed by winding a winding wire; and a magnetic core that forms a closed magnetic circuit. The reactor is used as a component of a converter of a hybrid vehicle, for example. The magnetic core of the reactor can be divided into an inner core portion that is located inside the winding portion, and an outer core portion that is located outside the winding portion. JP 2014-003125A also discloses a configuration in which the internal space of the winding portion of the coil is filled with resin.

SUMMARY

A reactor according to the present disclosure includes a coil including a winding portion formed by winding a winding wire; and a magnetic core that forms a closed magnetic circuit constituted by an inner core portion located inside the winding portion and an outer core portion located outside the winding portion. The reactor further includes an inner resin portion that fills a gap between the inner circumferential surface of the winding portion and the outer circumferential surface of the inner core portion, and when a side, of the outer core portion, that faces the inner core portion is defined as an inner side, and the opposite side is defined as an outer side. The outer core portion is provided with a through hole that is open to both the inner side and the outer side, and the through hole is filled with a portion of the inner resin portion.

A reactor manufacturing method according to the present disclosure includes a filling step that is a step of filling, with resin, a gap between a winding portion that is included in a coil and a magnetic core that is located inside and outside the winding portion to form a closed magnetic circuit. The reactor is the reactor according to the disclosure, and in the filling step, a gap between the inner circumferential surface of the winding portion and the outer circumferential surface of the inner core portion is filled with the resin from the outer side of the outer core portion via the through hole provided in the outer core portion.

DETAILED DESCRIPTION OF PREFERRED EMBODIMENTS

Figure 1:
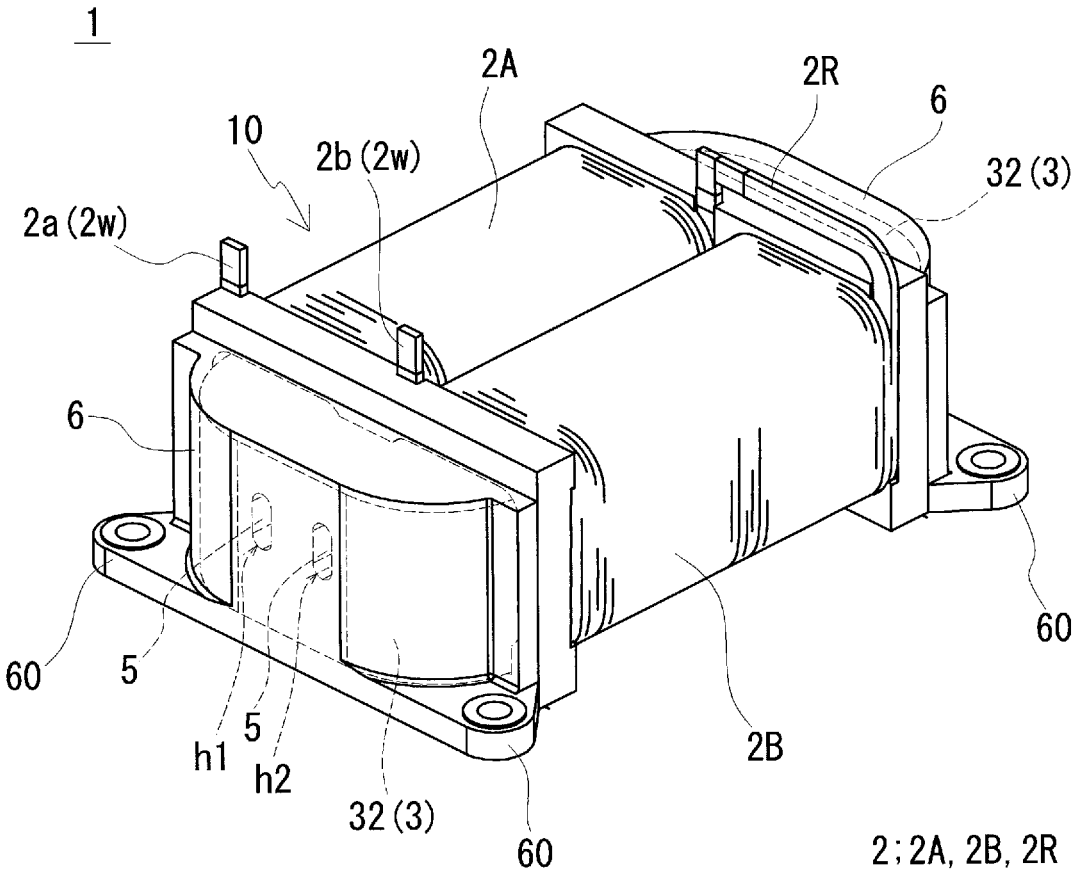
FIG. 1 is a perspective view of a reactor according to a first embodiment.

Problem to Be Solved by Present Disclosure

With the configuration according to JP 2014-003125A, there are cases where the internal space of the winding portion cannot be filled with a sufficient amount of resin. If the internal space of the winding portion is not sufficiently filled with resin, the strength of the resin is lower than when the winding portion is filled with a sufficient amount of resin. As a result, there is the risk of the resin being damaged due to vibrations or the like during the use of the reactor.

The present disclosure has been made in view of the above-described situation, and one objective of the present disclosure is to provide a reactor in which the internal space of a winding portion is filled with a sufficient amount of resin. Another objective of the present disclosure is to provide a method for manufacturing a reactor by which the internal space of a winding portion can be filled with a sufficient amount of resin.

Advantageous Effects of Present Disclosure

A reactor according to the present disclosure is a reactor in which the internal space of a winding portion is filled with a sufficient amount of resin.

A method for manufacturing a reactor according to the present disclosure is a method by which the internal space of a winding portion can be filled with a sufficient amount of resin.

DESCRIPTION OF EMBODIMENTS OF PRESENT DISCLOSURE

First, the following lists up and describes embodiments of the present disclosure.

A reactor according to an embodiment includes a coil including a winding portion formed by winding a winding wire; and a magnetic core that forms a closed magnetic circuit constituted by an inner core portion located inside the winding portion and an outer core portion located outside the winding portion.

The reactor further includes an inner resin portion that fills a gap between the inner circumferential surface of the winding portion and the outer circumferential surface of the inner core portion, and when a side, of the outer core portion, that faces the inner core portion is defined as an inner side, and the opposite side is defined as an outer side, the outer core portion is provided with a through hole that is open to both the inner side and the outer side, and the through hole is filled with a portion of the inner resin portion.

The reactor with the above-described configuration is manufactured by filling the internal space of the winding portion with resin from the outer side of the outer core portion via the through hole. Due to the presence of the through hole, it is possible to fill the internal space of the winding portion with a sufficient amount of resin, and it is less likely that an empty space or the like is formed in the internal space of the winding portion. The resin filled into the internal space of the winding portion is hardened, and thus constitutes an inner resin portion. An inner resin portion with a small number of empty spaces has high strength, and therefore the inner resin portion is less likely to be damaged due to vibrations occurring during the use of the reactor, and thus the operation of the reactor is stable.

In the reactor according to the embodiment, an opening portion of the through hole on the inner side may be open toward a gap between the inner circumferential surface of the winding portion and the inner core portion.

If the opening portion of the through hole on the inner side is open toward the aforementioned gap, when filling the internal space of the winding portion with resin that constitutes the internal resin portion, it is possible to reliably lead the resin to the internal space. As a result, the reactor with the above-described configuration is a reactor in which the internal space of the winding portion is filled with a sufficient amount of resin.

In the reactor according to the embodiment, the through hole may be provided as a single through hole.

Since it is easy to form a single through hole in a single outer core portion, it is possible to improve the productivity of the outer core portion. As a result, it is possible to improve the productivity of the reactor including the outer core portion.

In the reactor according to the embodiment, the coil may include a pair of winding portions that are arranged side by side, and when a position between one of the winding portions and the other of the winding portions is defined as a side-by-side middle position, the through hole may be provided as a first through hole that is open toward a gap between an area near the side-by-side middle position, of the inner circumferential surface of the one of the winding portions and the inner core portion that is located in the one of the winding portions, and a second through hole that is open toward a gap between an area near the side-by-side middle position, of the inner circumferential surface of the other of the winding portions and the inner core portion that is located in the other of the winding portions.

If the first through hole and the second through hole are provided, it is possible to fill each of the pair of winding portions with a sufficient amount of resin.

In the reactor according to the embodiment, a rim of an opening portion of the through hole on the outer side may be chamfered.

If the rim of the opening portion of the through hole on the outer side is chamfered, when the internal space of the winding portion is to be filled with resin from the outer side of the outer core portion via the through hole, the resin can easily flow into the through hole.

In the reactor according to the embodiment, at least one of the outer core portion and the inner core portion may be made of a powder compact that contains soft magnetic powder.

A powder compact can be manufactured at high productivity by press-molding a soft magnetic powder. Therefore, it is also possible to improve the productivity of the reactor in which a core piece made of a powder compact is employed. In addition, it is possible to increase the proportion of soft magnetic powder contained in the core piece by forming the core piece as a powder compact, and thus improve the magnetic properties (the relative magnetic permeability and the saturation magnetic flux density) of the core piece. Therefore, it is possible to improve the performance of the reactor in which the core piece made of a powder compact is employed.

In the reactor according to the embodiment, at least one of the outer core portion and the inner core portion may be made of a composite material that contains resin and soft magnetic powder dispersed in the resin.

If a composite material is used, it is easier to control the amount of soft magnetic powder in the resin. Therefore, it is easier to control the performance of the reactor in which the core piece is made of a composite material.

In the reactor according to the embodiment, the coil may include an integration resin that is separate from the inner resin portion and integrates turns of the winding portion into one piece.

With the above-described configuration, it is possible to improve the productivity of the reactor. This is because, if the turns of the winding portions are integrated into one piece, the winding portion is less likely to bend, and when manufacturing the reactor, it is easier to dispose the magnetic core in the internal space of the winding portion. Also, if the turns of the winding portion are integrated into one piece, it is less likely that large gaps are formed between the turns, and when manufacturing the reactor, it is less likely that the resin filled into the internal space of the winding portion leaks out of the gaps between the turns. As a result, it is less likely that a large empty space is formed in the internal space of the winding portion.

The reactor according to the embodiment may further include an end surface interposed member that is interposed between an end surface of the winding portion in an axial direction and the outer core portion, wherein the end surface interposed member may be provided with a resin filling hole that is used to fill, from the outer side, an internal space of the winding portion with resin that constitutes the inner resin portion.

If the end surface interposed member is used, it is easier to determine the positions of the inner core portion and the outer core portion relative to each other when manufacturing the reactor. Also, if the end surface interposed member is provided with the resin filling hole, it is easier to fill the internal space of the winding portion with resin when manufacturing the reactor.

The reactor according to the embodiment in which the end surface interposed member is provided with the resin filling hole may further include: an outer resin portion that integrates the outer core portion with the end surface interposed member, wherein the outer resin portion and the inner resin portion may be connected to each other via the resin filling hole.

Since the outer resin portion and the inner resin portion are connected to each other via the resin filling hole, the resin portions can be formed by performing molding once. In other words, despite being provided with the outer resin portion in addition to the inner resin portion, the reactor with this configuration can be obtained by performing resin molding only once, and thus productivity is excellent.

In the reactor according to the embodiment, the inner core portion may include a plurality of divisional cores and the inner resin portion that fills gaps between the divisional cores.

The inner resin portion that fills the gaps between the divisional cores serves as a resin gap portion that controls the magnetic properties of the magnetic core. In other words, a reactor with this configuration does not require gap members that are made of another material such as alumina. Since gap members are unnecessary, productivity is excellent.

The reactor according to the embodiment in which the inner core portion includes a plurality of divisional cores may further include an inner interposed member that is interposed between the inner circumferential surface of the winding portion and the outer circumferential surface of the inner core portion, wherein the inner interposed member may include a plurality of divisional pieces that separate the divisional cores from each other.

If the inner interposed member is used, when filling the winding portion with resin through the reactor manufacturing process, it is possible to reliably separate the winding portion and the divisional cores that constitute the inner core portion from each other, and it is possible to reliably insulate the winding portion and the inner core portion from each other. Also, if the inner interposed member includes a plurality of divisional pieces that hold the divisional cores in the state of being separated from each other, it is possible to reliably form resin gap portions between divisional cores that are adjacent to each other.

A reactor manufacturing method according to an embodiment is: a method for manufacturing a reactor, the method including a filling step that is a step of filling, with resin, a gap between a winding portion that is included in a coil and a magnetic core that is located inside and outside the winding portion to form a closed magnetic circuit, wherein the reactor is the reactor according to the embodiment, and in the filling step, a gap between the inner circumferential surface of the winding portion and the outer circumferential surface of the inner core portion is filled with the resin from the outer side of the outer core portion via the through hole provided in the outer core portion.

According to the above-described reactor manufacturing method, it is possible to manufacture the reactor according to the embodiment in which the internal space of the winding portion is filled with a sufficient amount of resin.

Details of Embodiments of Present Disclosure

The following describes embodiments of a reactor according to the present disclosure with reference to drawings. Elements having the same name are denoted by the same reference numerals throughout the drawings. Note that the present disclosure is not limited to configurations shown in the embodiments, and is specified by the scope of claims. All changes that come within the meaning and range of equivalency of the claims are intended to be embraced therein.

First Embodiment

The first embodiment describes a configuration of a reactor 1 with reference to FIGS. 1 to 4. The reactor 1 shown in FIG. 1 includes a combined body 10 formed by combining a coil 2, a magnetic core 3, and an insulative interposed member 4. The combined body 10 also includes inner resin portions 5 (see FIG. 2) that are located inside winding portions 2A and 2B of the coil 2, and outer resin portions 6 that cover outer core portions 32 that are included in the magnetic core 3. One feature of the reactor 1 is that through holes (a first through hole h1 and a second through hole h2) are formed in the outer core portion 32. The following describes each of the components included in the reactor 1 in detail, and also describes the technical significance of the shapes, functions, and so on of the above-described through holes h1 and h2, where appropriate.

Combined Body

Figure 3:
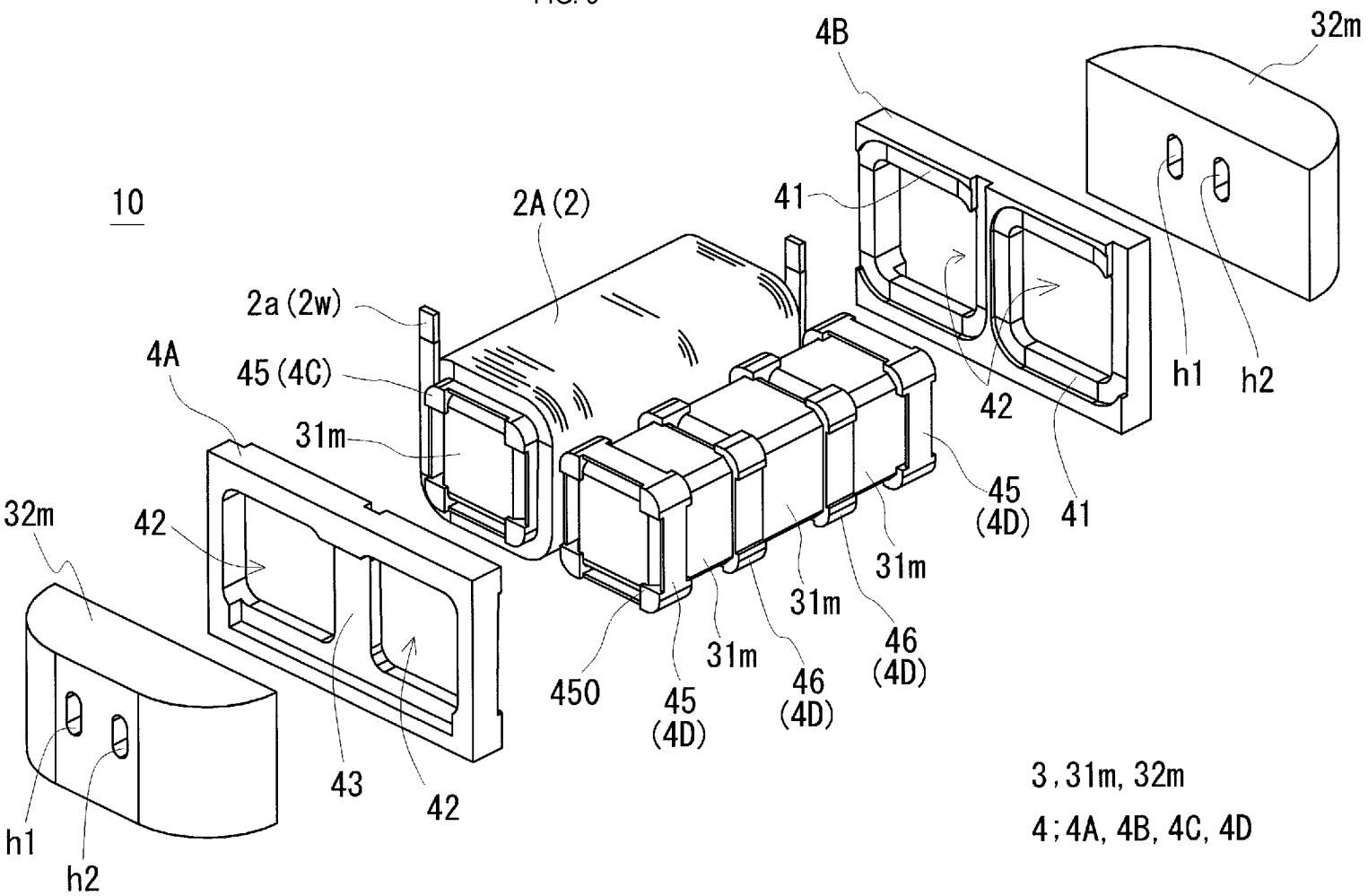
FIG. 3 is an exploded perspective view of a portion of a combined body included in the reactor according to the first embodiment.

The combined body 10 will be described mainly with reference to FIG. 3. In FIG. 3, some components of the combined body 10 (e.g. the winding portion 2B shown in FIG. 1) are omitted.

Coil

The coil 2 according to the present embodiment includes a pair of winding portions 2A and 2B, and a coupling portion 2R that couples the winding portions 2A and 2B to each other (see FIG. 1 for the winding portion 2B and the coupling portion 2R). The winding portions 2A and 2B each have a hollow tubular shape with the same number of turns wound in the same direction, and are arranged side by side such that their axial directions are parallel with each other. In this example, the coil 2 is formed by coupling the winding portions 2A and 2B, which have been manufactured using separate winding wires. However, the coil 2 may be manufactured using a single winding wire.

The winding portions 2A and 2B according to the present embodiment each have a rectangular tube shape. Winding portions 2A and 2B that have a rectangular tube shape are winding portions that have an end surface that has a rectangular shape (which may be a square shape) with rounded corners. As a matter of course, the winding portions 2A and 2B may also have a cylindrical shape. Winding portions that have a cylindrical shape are winding portions that have an end surface that has a closed curved surface shape (such as an elliptical shape, a perfect circular shape, or a race track shape).

The coil 2 including the winding portions 2A and 2B may be made of a coated wire in which the outer circumferential surface of a conductor such as a flat wire or a round wire that is made of a conductive material such as copper, aluminum, magnesium, or an alloy thereof is coated with an insulative coating that is made of an insulative material. In the present embodiment, the winding portions 2A and 2B are formed through edgewise-winding of a coated flat wire that includes a conductor that is made of a copper flat wire (a winding wire 2*w*) and an insulative coating that is made of enamel (typically polyamide imide).

Two end portions 2*a* and 2*b* of the coil 2 are drawn out of the winding portions 2A and 2B, and are connected to a terminal member, which is not shown. The insulative coating, which is made of enamel or the like, has been peeled off from the end portions 2*a* and 2*b*. An external device such as a power supply for supplying power to the coil 2 is connected via the terminal member.

Integration Resin

It is preferable that the coil 2 with the above-described configuration is formed as an integrated member, using resin. In the case of this example, the winding portions 2A and 2B of the coil 2 are formed as integrated members, using an integration resin 20 (see FIG. 2). The integration resin 20 in this example is formed by fusing a coating layer of a heat-fusing resin that is formed on the outer circumferential surface of a winding wire 2*w* (the outer circumferential surface of the insulative coating that is made of enamel or the like), and is very thin. Therefore, despite the winding portions 2A and 2B being formed as integrated members using an integration resin 20, the shape of, and the boundary between, the turns of the winding portions 2A and 2B can be seen from the outside. Examples of the material of the integration resin 20 include a resin that can be thermally fused, e.g. a thermosetting resin such as an epoxy resin, a silicone resin, and unsaturated polyester.

Figure 2:
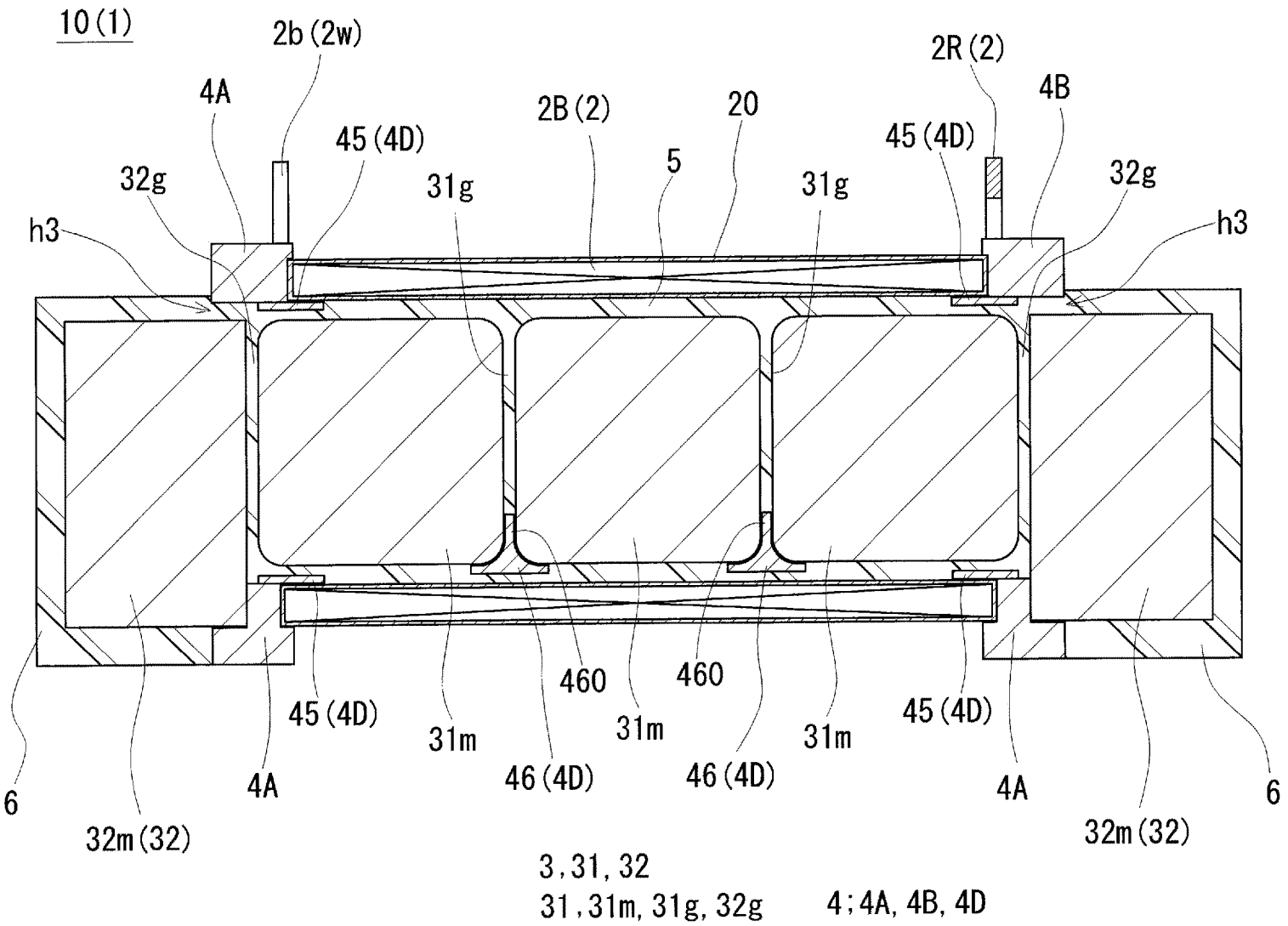
FIG. 2 is a longitudinal cross-sectional view of the reactor shown in FIG. 1, through a winding portion on the right of the drawing sheet.

Although the integration resin 20 in FIG. 2 is exaggerated, it is very thin in reality. The integration resin 20 integrates the turns that constitute the winding portion 2B into one piece, and restricts the winding portion 2B from expanding or contracting in the axial direction (the same applies to the winding portion 2A). In this example, the integration resin 20 is formed by fusing a heat-fusing resin formed on a winding wire 2*w*, and therefore the integration resin 20 uniformly fills the gaps between the turns. A thickness t1 of the integration resin 20 between turns is approximately twice the thickness of a heat-fusing resin formed on the surface of the winding wire 2*w* that has not been wound, and the thickness t1 is specifically at least 20 μm and at most 2 mm, for example. By setting the thickness t1 to be large, it is possible to firmly integrate the turns into one piece, and by setting the thickness t1 to be small, it is possible to prevent the winding portion 2B from being too long in the axial direction.

A thickness t2 of the integration resin 20 on the outer circumferential surface and the inner circumferential surface of the winding portion 2B is approximately the same as the thickness of the heat-fusing resin formed on the surface of the winding wire 2*w* that has not been wound, and the thickness t2 is at least 10 μm and at most 1 mm, for example. By setting the thickness t2 of the integration resin 20 on the inner circumferential surface and the outer circumferential surface of the winding portion 2B to be at least 10 μm, it is possible to firmly integrate the turns of the winding portions 2A and 2B into one piece so that the turns do not become separated from each other. By setting the aforementioned thickness to be at most 1 mm, it is possible to prevent the integration resin 20 from degrading the heat dissipation properties of the winding portion 2B.

Here, each of the winding portions 2A and 2B of the coil 2 shown in FIG. 1, which has a rectangular tube shape, includes four corner portions formed by bending a winding wire 2*w*, and flat portions where a winding wire 2*w* is not bent. In this example, in each of the winding portions 2A and 2B, turns are integrated into one piece in both the corner portions and the flat portions, using an integration resin 20 (see FIG. 2). However, it is also possible to employ a configuration in which turns are integrated into one piece only in some portions of the winding portions 2A and 2B, e.g. only in the corner portions, using an integration resin 20.

In the corner portions of the winding portions 2A and 2B, which are formed through edgewise-winding of a winding wire 2*w*, the inner side of a bend is likely to be thicker than the outer side of the bend. If this is the case, in the flat portions of the winding portions 2A and 2B, a heat-fusing resin is present on the outer circumferential surface of a winding wire 2*w*, but, in some cases, turns are not integrated into one piece and become separated from each other. If gaps in the flat portions are sufficiently small, resin filled into the internal spaces of the winding portions 2A and 2B cannot pass through the gaps in the flat portions due to the effect of surface tension.

Magnetic Core

The magnetic core 3 is formed by combining a plurality of divisional cores 31*m* and 32*m*, which can be classified into inner core portions 31 and outer core portions 32 for the sake of convenience (see FIGS. 2 and 3 in combination).

Inner Core Portions

As shown in FIG. 2, an inner core portion 31 is located inside the winding portion 2B of the coil 2 (the same applies to the winding portion 2A). Here, the inner core portion 31 is a portion of the magnetic core 3 extending in the axial direction of the winding portions 2A and 2B of the coil 2. In this example, the two end portions of a portion of the magnetic core 3 extending in the axial direction of the winding portion 2B protrude outward from the winding portion 2B, and these protruding portions are also included in the inner core portion 31.

Each inner core portion 31 in this example is constituted by three divisional cores 31*m*, gap portions 31*g* that are each formed between divisional cores 31*m*, and gap portions 32*g* that are each formed between a divisional core 31*m* and a divisional core 32*m* described below. The gap portions 31*g* and 32*g* in this example are formed using an inner resin portion 5 described below. The inner core portions 31 have a shape that matches the internal shape of the winding portion 2A (2B), which is a substantially rectangular parallelepiped shape in this example.

Outer Core Portions

As shown in FIG. 3, the outer core portions 32 are portions that are located outside the winding portions 2A and 2B, and have a shape that connects end portions of the pair of inner core portions 31. Each outer core portion 32 in this example is constituted by a divisional core 32*m* that is columnar and has substantially domed upper and lower surfaces. When a side, of an outer core portion 32 (a divisional core 32*m*), that faces an inner core portion 31 is defined as an inner side, and the opposite side is defined as an outer side, each outer core portion 32 is provided with a first through hole h1 and a second through hole h2 that are open to both the inner side and the outer side of the outer core portion 32. The through holes h1 and h2 serve as paths of resin when the internal spaces of the winding portions 2A and 2B are filled with the resin, which constitutes the inner resin portions 5 described below. Therefore, the internal spaces of the through holes h1 and h2 are filled with portions of the inner resin portions 5 (see FIG. 1).

The opening portion of the first through hole h1 (the second through hole h2) on the inner side is open toward a gap between the inner circumferential surface of the winding portion 2A (2B) and the inner core portion 31. More specifically, when a position between the winding portion 2A and the winding portion 2B is defined as a side-by-side middle position, the first through hole h1 (the second through hole h2) is open toward the gap between a side-by-side middle position-side portion of the inner circumferential surface of the winding portion 2A (2B) and the inner core portion 31 located inside the winding portion 2A (2B). With such a configuration, when the internal spaces of the winding portions 2A and 2B are filled with resin, the internal spaces of the winding portions 2A and 2B can be reliably filled with resin.

The dimensions of the through holes h1 and h2 may be selected as appropriate as long as the magnetic path in the outer core portion 32 is not excessively narrowed. For example, it is preferable that the length of the through holes h1 and h2 in the height direction of the combined body 10 (a direction that is orthogonal to the parallel directions in which the winding portions 2A and 2B extend) is at least 10% and at most 50% of the height of the outer core portion 32. The lower limit value of the aforementioned height may be 20% or even 25% of the height of the outer core portion 32, and the upper limit value may be 40% or even 30% of the height of the outer core portion 32. The width of the through holes h1 and h2 (the length in a direction that is orthogonal to the aforementioned length) is the length in a direction that extends along the magnetic path. Although the width does not have a significant influence on the magnetic properties of the outer core portion 32, the width has an influence on the strength of the outer core portion 32. Therefore, the width may be selected as appropriate as long as the strength of the outer core portion 32 does not decrease. For example, the first through hole h1 and the second through hole h2 may be connected so that one large through hole is formed. One large through hole can be easily formed, and makes it easier to fill the winding portions 2A and 2B with resin. Another through hole may also be formed in addition to the above-described through holes h1 and h2.

It is preferable that the rims of the outer side opening portions of the through holes h1 and h2 are chamfered. If the rims are chamfered, when the internal spaces of the winding portions 2A and 2B are to be filled with resin from the outer side of the outer core portion 32 (a divisional core 32*m*) via the through holes h1 and h2, the resin can easily flow into the through holes h1 and h2. Chamfering may be round chamfering or 45-degree chamfering, for example.

The above-described divisional cores 31*m* and 32*m* are powder compacts formed through pressure forming, using a raw material powder that contains soft magnetic powder. Soft magnetic powder is an aggregation of magnetic particles that include particles of an iron-group metal such as iron, an alloy thereof (an Fe—Si alloy, an Fe—Ni alloy, etc.), or the like. The raw material powder may contain a lubricant. The divisional cores 31*m* and 32*m* may be formed as compacts that are made of a composite material that contains soft magnetic powder and resin, unlike in this example. The soft magnetic powder and the resin contained in the composite material may be the same as the soft magnetic powder and the resin that can be used in the powder compact. Insulative coatings that are made of a phosphate or the like may be formed on the surfaces of the magnetic particles. It is possible that either the divisional cores 31*m* (the inner core portions 31) or the divisional cores 32*m* (the outer core portions 32) are formed as powder compacts, and the others are formed as compacts that are made of a composite material. Alternatively, the divisional cores 31*m* and 32*m* may be formed as laminated steel plates.

Insulative Interposed Member

As shown in FIGS. 2 and 3, the insulative interposed member 4 is a member that ensures insulation between the coil 2 and the magnetic core 3, and is constituted by end surface interposed members 4A and 4B and inner interposed members 4C and 4D. The insulative interposed member 4 can be formed using a thermoplastic resin, such as a polyphenylene sulfide (PPS) resin, a polytetrafluoroethylene (PTFE) resin, a liquid crystal polymer (LCP), a polyamide (PA) resin such as nylon 6 or nylon 66, a polybutylene terephthalate (PBT) resin, or a acrylonitrile butadiene styrene (ABS) resin, for example. Alternatively, the insulative interposed member 4 may be formed using a thermosetting resin such as an unsaturated polyester resin, an epoxy resin, a urethane resin, or a silicone resin, for example. It is also possible to improve the heat dissipation properties of the insulative interposed member 4 by adding a ceramic filler to the aforementioned resins. Non-magnetic powder of alumina or silica, for example, may be used as the ceramic filler.

End Surface Interposed Members

The end surface interposed members 4A and 4B will be described mainly with reference to FIG. 3. The end surface interposed members 4A and 4B in this example have the same shape.

Two turn-housing portions 41 that house end portions of the winding portions 2A and 2B in the axial direction are formed in the coil 2-side surface of each of the end surface interposed members 4A and 4B (see the end surface interposed member 4B). The turn-housing portions 41 are formed so that end surfaces of the winding portions 2A and 2B in the axial direction can be entirely brought into surface contact with the end surface interposed member 4A. More specifically, the turn-housing portions 41 each have a square loop shape that surrounds a core insertion hole 42 described below. The right edge of each turn-housing portion 41 reaches the upper end of the end surface interposed member 4A, so that end portions of the winding portions 2A and 2B can be drawn upward. Due to the turn-housing portions 41 bringing end surfaces of the winding portions 2A and 2B in the axial direction into surface contact with the end surface interposed member 4A, resin is prevented from leaking from the contact areas.

Each of the end surface interposed members 4A and 4B is also provided with a pair of core insertion holes 42 and a fitting portion 43 (see the end surface interposed member 4A) in addition to the above-described turn-housing portions 41. The core insertion holes 42 are holes into which an assembly including the inner interposed members 4C and 4D and the divisional cores 31*m* is to be fitted. The fitting portion 43 is a recessed portion into which a divisional core 32*m*, which constitutes an outer core portion 32, is to be fitted.

Figure 4:
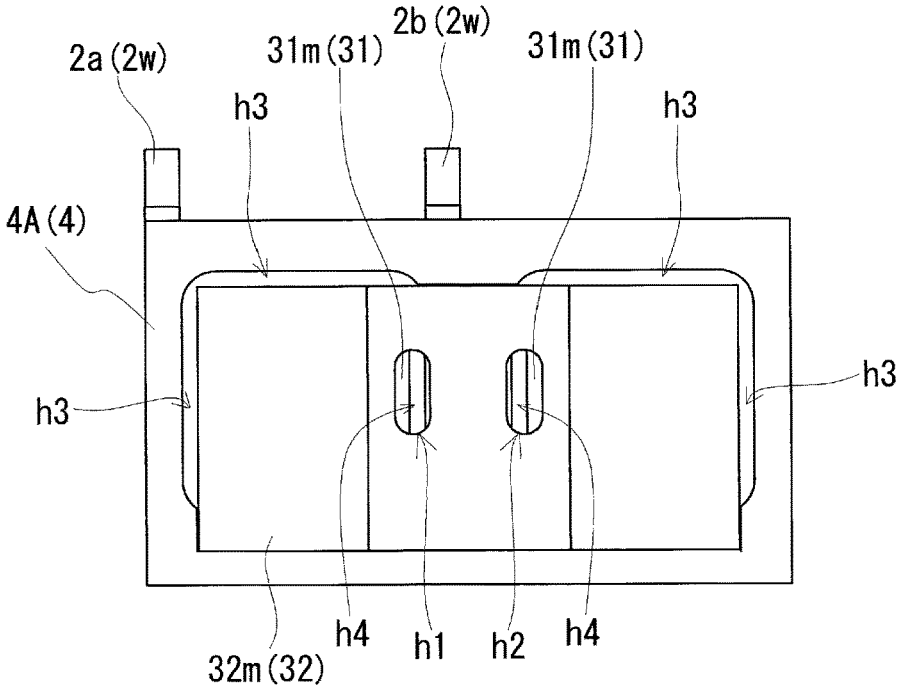
FIG. 4 is a schematic view of the combined body included in the reactor according to the first embodiment, seen from an outer side of an outer core portion.

An outer portion and an upper portion of each of the aforementioned core insertion holes 42 are recessed outward in a radial direction. As shown in FIG. 4, when a divisional core 32*m* is fitted into the fitting portion of the end surface interposed member 4A, resin filling holes h3 are formed in this recessed portion, at side edge positions and upper edge positions of the divisional core 32*m*. The resin filling holes h3 penetrate through the end surface interposed member 4A in the thickness direction thereof, from the outer core portion 32-side (the divisional core 32*m*-side), which is the front side of the drawing sheet, toward the end surfaces of the winding portions 2A and 2B (see FIG. 3) in the axial direction, which is on the back side of the drawing sheet. The resin filling holes h3 are in communication with space between the inner circumferential surfaces of the winding portions 2A and 2B and the outer circumferential surfaces of the inner core portions 31 (the divisional cores 31*m*) on the back side of the drawing sheet (see FIG. 2 also).

Inner Interposed Members

The inner interposed members 4C and 4D have the same configuration. The inner interposed members 4C and 4D in this example are constituted by a plurality of divisional pieces. The divisional pieces can be classified into end portion divisional pieces 45 that are each interposed between a divisional core 32*m* and a divisional core 31*m*, and intermediate divisional pieces 46 that are interposed between divisional cores 31*m* that are adjacent to each other.

Each end portion divisional piece 45 is a rectangular frame-shaped member, and abutting portions 450 are respectively provided at the four corners of each end portion divisional piece 45, against which a divisional core 31*m* is abutted. Due to the presence of the abutting portions 450, a separating portion that has a predetermined length is formed between a divisional core 31*m* and a divisional core 32*m*. Each intermediate divisional piece 46 is a substantially U-shaped member, and abutting portions 460 (see FIG. 2) are respectively provided at the four corners of each end intermediate divisional piece 46, against which a divisional core 31*m* is abutted. Due to the presence of the abutting portions 460, a separating portion that has a predetermined length is formed between divisional cores 31*m* that are adjacent to each other. These separating portions are portions into which an inner resin portion 5 enters, and thus gap portions 31*g* and 32*g* are formed (see FIG. 2).

Inner Resin Portions

As shown in FIG. 2, the inner resin portion 5 is located inside the winding portion 2B (the same applied to the winding portion 2A, which is not shown), and joins the inner circumferential surface of the winding portion 2B and the outer circumferential surfaces of the divisional cores 31*m* (the inner core portions 31) to each other.

The winding portion 2B is integrated into one piece using an integration resin 20, and therefore the inner resin portion 5 is retained in the internal space of the winding portion 2B without reaching from the inner circumferential surface to the outer circumferential surface of the winding portion 2B. Portions of the inner resin portion 5 enter a space between divisional cores 31*m* and a space between a divisional core 31*m* and a divisional core 32*m*, and thus gap portions 31*g* and 32*g* are formed.

Examples of the inner resin portions 5 include a thermosetting resin such as an epoxy resin, a phenol resin, a silicone resin, or a urethane resin, a thermoplastic resin such as a PPS resin, a PA resin, a polyimide resin, or a fluororesin, a room-temperature setting resin, and a low-temperature setting resin. It is also possible to improve the heat dissipation properties of the inner resin portions 5 by adding a ceramic filler such as alumina or silica to these resins. It is preferable that the inner resin portions 5 are formed using the same material as the end surface interposed members 4A and 4B and the inner interposed members 4C and 4D. By forming these three kinds of members using the same material, it is possible to equalize the coefficient of linear expansion of the three kinds of members, and it is possible to prevent the members from being damaged due to thermal expansion or contraction.

Almost no large empty space is formed inside the inner resin portions 5, and furthermore, almost no small empty space is formed inside the inner resin portions 5. The reason for this fact will be described in detail below, in a description of a method for manufacturing a reactor.

Outer Resin Portions

As shown in FIGS. 1 and 2, the outer resin portions 6 cover the outer circumferential surfaces of the divisional cores 32*m* (the outer core portions 32) overall, fix the divisional cores 32*m* to the end surface interposed members 4A and 4B, and protect the divisional cores 32*m* from an external environment. Here, the lower surfaces of the divisional cores 32*m* may be exposed from the outer resin portions 6 to the outside. If this is the case, it is preferable that lower portions of the divisional cores 32*m* extend so as to be substantially flush with the lower surfaces of the end surface interposed members 4A and 4B. By bringing the lower surfaces of the divisional cores 32*m* into direct contact with an installation surface on which the combined body 10 is to be installed, or by interposing an adhesive or an insulation sheet between the installation surface and the lower surfaces of the divisional cores 32*m*, it is possible to improve the heat dissipation properties of the magnetic core 3 including the divisional cores 32*m*.

The outer resin portions 6 in this example are provided on end surfaces of the interposed members 4A and 4B on the divisional cores 32*m*-side, and do not reach the outer circumferential surfaces of the winding portions 2A and 2B. Considering the function of the outer resin portions 6 of fixing and protecting the divisional cores 32*m*, formation ranges in which the outer resin portions 6 are formed are sufficient if they are as large as those shown in the figures, and such formation ranges are preferable in that the amount of resin to be used can be reduced. Of course, the outer resin portions 6 may reach the winding portions 2A and 2B, unlike in the example shown in the figures.

As shown in FIG. 2, the outer resin portions 6 in this example are continuous with the inner resin portions 5 via the resin filling holes h3 in the end surface interposed members 4A and 4B. That is, the outer resin portions 6 and the inner resin portions 5 are formed at the same time using the same resin. It is also possible to separately form the outer resin portions 6 and the inner resin portions 5, unlike in this example.

The outer resin portions 6 can be formed using resin that is the same as resin that can be used to form the inner resin portions 5. If the outer resin portions 6 and the inner resin portions 5 are continuous as in this example, these resin portions are formed using the same resin.

In addition, fixing portions 60 (see FIG. 1) for fixing the combined body 10 to the installation surface (e.g. the bottom surface of a casing) are formed on the outer resin portions 6. For example, fixing portions 60 for fixing the combined body 10 to the installation surface, using bolts, can be formed by embedding collars that are made of highly rigid metal or resin in the outer resin portions 6.

The combined body 10 can be used in the state of being immersed in a liquid refrigerant. Although the liquid refrigerant is not particularly limited, if the reactor 1 is used in a hybrid vehicle, an ATF (Automatic Transmission Fluid) or the like may be used as the liquid refrigerant. In addition, a fluorinated inert liquid such as Fluorinert (registered trademark), a Freon-type refrigerant such as HCFC-123 or HFC-134a, an alcohol-based refrigerant such as methanol or alcohol, or a ketone-based refrigerant such as acetone may also be used as the liquid refrigerant.

Effects

In the reactor 1 in this example, almost no large empty space is formed in the inner resin portions 5 that fill the internal spaces of the winding portions 2A and 2B. In particular, as shown in FIG. 2, the inner resin portion 5 sufficiently fills the spaces between the divisional cores 31*m* and the divisional cores 32*m*, and the spaces between the divisional cores 31*m*. Thus, no large empty space is formed in the gap portions 32*g* and 31*g* that are included in the inner resin portion 5. The inner resin portion 5 without a large empty space or a small empty space has high strength, and therefore the inner resin portion 5 is less likely to be damaged due to vibrations occurring during the use of the reactor 1, and thus the operation of the reactor 1 is stable. The reason why it is less likely that an empty space is formed in the inner resin portion 5 will be described in detail below, in a description of a method for manufacturing a reactor.

In the reactor 1 in this example, the outer circumferential surfaces of the winding portions 2A and 2B of the coil 2 are not covered by molded resin, and are directly exposed to the external environment. Therefore, the reactor 1 in this example has excellent heat dissipation properties. If the combined body 10 of the reactor 1 is immersed in a liquid refrigerant, the heat dissipation properties of the reactor 1 can be further improved.

Use

The reactor 1 in this example can be used as a constituent member of a power converter device such as a bidirectional DC-DC converter that is mounted on an electrical vehicle such as a hybrid vehicle, an electrical vehicle, or a fuel cell vehicle.

Method for Manufacturing Reactor

Next, the following describes an example of a reactor manufacturing method for manufacturing the reactor 1 according to the first embodiment. Generally, the reactor manufacturing method includes the following steps. The reactor manufacturing method is mainly described with reference to FIGS. 3 to 5.

Coil Manufacturing Step
Integration Step
Assembly Step
Filling Step
Hardening Step

Coil Manufacturing Step

In this step, the winding wire 2*w* is prepared, and a portion of the winding wire 2*w* is wound to manufacture the coil 2. A well-known winding machine can be used to wind the winding wire 2*w*. A coating layer that is made of heat-fusing resin, which constitutes the integration resin 20 described with reference to FIG. 2 can be formed on the outer circumferential surface of the winding wire 2*w*. The thickness of the coating layer may be selected as appropriate. If the integration resin 20 is not provided, a winding wire 2*w* without a coating layer can be used, and the following integration step is unnecessary.

Integration Step

In this step, the winding portions 2A and 2B of the coil 2 manufactured in the coil manufacturing step are integrated into one piece using the integration resin 20 (see FIG. 2). If a coating layer that is made of heat-fusing resin is formed on the outer circumferential surface of the winding wire 2*w*, the coil 2 is subjected to thermal treatment, and thus the integration resin 20 can be formed. In contrast, if no coating layer is formed on the outer circumferential surface of the winding wire 2*w*, resin is applied to the outer circumferential surfaces and the inner circumferential surfaces of the winding portions 2A and 2B of the coil 2, the resin is hardened, and thus the integration resin 20 can be formed. This integration step may be performed after the assembly step and before the filling step, which are described below.

Assembly Step

In this step, the coil 2, the divisional cores 31*m* and 32*m* that constitute the magnetic core 3, and the insulative interposed member 4 are combined together. For example, as shown in FIG. 3, first assemblies, in which the divisional cores 31*m* are arranged in the inner interposed members 4C and 4D, are manufactured, and the first assemblies are arranged in the internal spaces of the winding portions 2A and 2B. Next, the end surface interposed members 4A and 4B are abutted against proximal end surfaces and distal end surfaces of the winding portions 2A and 2B, and are sandwiched between the pair of divisional cores 32*m*, and thus a second assembly, which is a combination of the coil 2, the divisional cores 31*m* and 32*m*, and the insulative interposed member 4, is manufactured.

Here, as shown in FIG. 4, when the second assembly is seen from the outside of a divisional core 32*m* (an outer core portion 32), the resin filling holes h3 that are used to fill the internal spaces of the winding portions 2A and 2B with resin are formed at side edge positions and upper edge positions of the divisional core 32*m*. The resin filling holes h3 are constituted by gaps between the core insertion holes 42 (see FIG. 3) of the end surface interposed members 4A and 4B and the outer core portions 32 inserted into the core insertion holes 42. Also, gaps between the core insertion holes 42 and the divisional cores 31*m* (the inner core portions 31) are seen inside the through holes h1 and h2 of the divisional core 32*m*, and these gaps also serve as resin filling holes h4.

Filling Step

Figure 5:
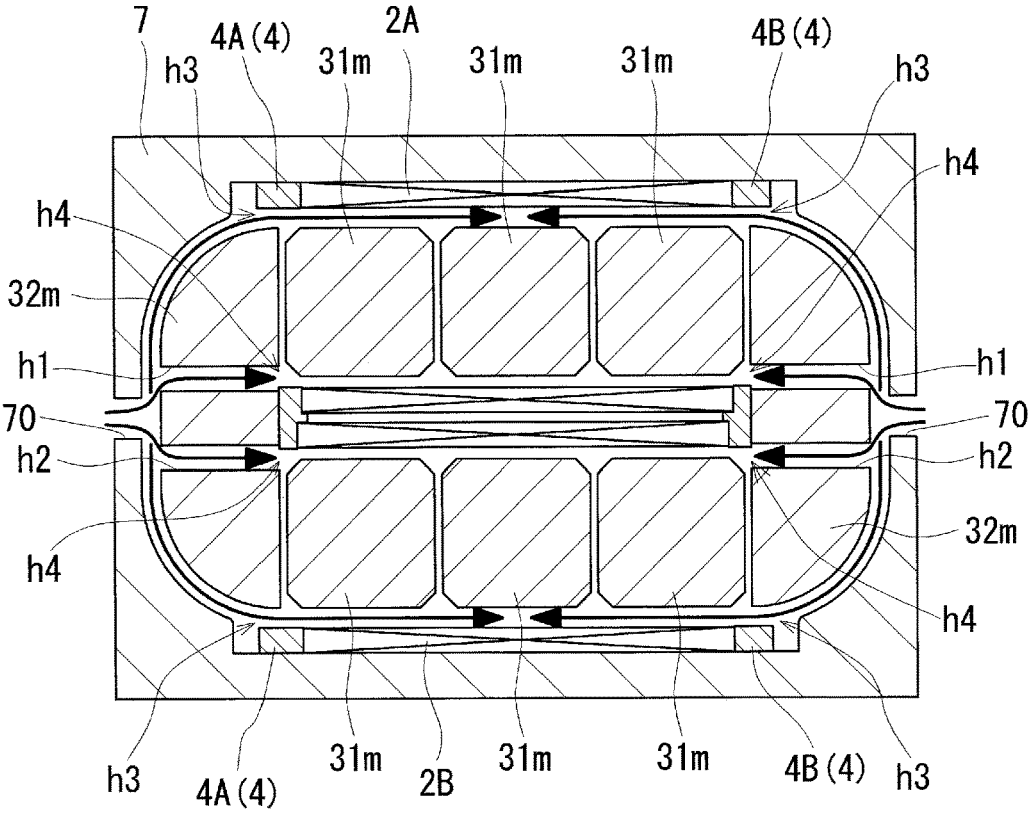
FIG. 5 is a diagram illustrating a method for manufacturing the reactor according to the first embodiment.

In the filling step, the inner spaces of the winding portions 2A and 2B of the second assembly are filled with resin. In this example, as shown in FIG. 5, the second assembly is set in a mold 7, and injection molding is performed, by which resin is injected into the mold 7. FIG. 5 shows a horizontal cross sections of the mold 7 and the second assembly, and the flow of the resin is indicated by black arrows. In FIG. 5, the inner interposed members are omitted.

Resin is injected from two resin injection holes 70 of the mold 7. The resin injection holes 70 are located at positions corresponding to the through holes h1 and h2 of the divisional cores 32*m*, and resin is injected from the outer side of each divisional core 32*m* (the side opposite the coil 2). The resin filled into the mold 7 covers the outer circumferential surfaces of the divisional cores 32*m*, and flows into the internal spaces of the winding portions 2A and 2B via the through holes h1 and h2 of the divisional cores 32*m* and the resin filling holes h4 of the end surface interposed members 4A and 4B. Also, resin flows around the outer circumferential surfaces of the divisional cores 32*m*, and flows into the internal space of the winding portions 2A and 2B via the resin filling holes h3 as well.

The resin filled into the internal spaces of the winding portions 2A and 2B flows not only into gaps between the inner circumferential surfaces of the winding portions 2A and 2B and the outer circumferential surfaces of the divisional cores 31*m*, but also into a gap between two divisional cores 31*m* that are adjacent to each other, and a gap between a divisional core 31*m* and an outer core portion 32 (a divisional core 32*m*), and thus the gap portions 31*g* and 32*g* are formed. Resin that is filled into the internal spaces of the winding portions 2A and 2B at high pressure through injection molding sufficiently fills the narrow gaps between the winding portions 2A and 2B and the inner core portions 31, but hardly leaks out of the winding portions 2A and 2B. This is because, as shown in FIG. 2, the end surfaces of the winding portion 2B in the axial direction and the end surface interposed members 4A and 4B are in surface contact, and the winding portion 2B is formed as an integrated member, using the integration resin 20.

Hardening Step

In the hardening step, the resin is hardened through thermal processing or the like. As shown in FIG. 2, portions of the hardened resin in the internal spaces of the winding portions 2A and 2B constitute the inner resin portions 5, and portions that cover the divisional cores 32*m* constitute the outer resin portions 6.

Effects

With the above-described reactor manufacturing method, it is possible to manufacture the combined body 10 of the reactor 1 shown in FIG. 1. In this reactor 1, due to resin flowing into the internal spaces of the winding portions 2A and 2B particularly via the through holes h1 and h2, the internal spaces of the winding portions 2A and 2B are filled with a sufficient amount of resin, and it is less likely that a large empty space is formed in the inner resin portions 5 that are formed in the internal spaces of the winding portions 2A and 2B.

Also, with the reactor manufacturing method in this example, the inner resin portions 5 and the outer resin portions 6 are formed integrally with each other, and the filling step and the hardening step only need to be performed once. Therefore, it is possible to manufacture the combined body 10 at high productivity.

Second Embodiment

The combined body 10 according to the first embodiment may be housed in a casing, and the combined body 10 may be embedded in the casing using potting resin. For example, the second assembly manufactured through the assembly step according to the reactor manufacturing method according to the first embodiment is housed in a casing, and the casing is filled with potting resin. If this is the case, portions of potting resin that surround the outer circumferential surfaces of the divisional cores 32*m* (the outer core portions 32) constitute the outer resin portions 6. Also, portions of potting resin that flow into the winding portions 2A and 2B via the through holes h1 and h2 of the divisional cores 32*m* and the resin filling holes h3 and h4 of the end surface interposed members 4A and 4B constitute the inner resin portions 5.

The invention claimed is:

1. A reactor comprising: a coil including a winding portion formed by winding a winding wire; and a magnetic core that forms a closed magnetic circuit constituted by an inner core portion located inside the winding portion and an outer core portion located outside the winding portion, wherein the reactor further comprises an inner resin portion that fills a gap between the inner circumferential surface of the winding portion and the outer circumferential surface of the inner core portion, and when a side, of the outer core portion, that faces the inner core portion is defined as an inner side, and the opposite side is defined as an outer side, the outer core portion is provided with a through hole that is open to both the inner side and the outer side, and the through hole is filled with a portion of the inner resin portion.

2. The reactor according to claim 1, wherein an opening portion of the through hole on the inner side is open toward a gap between the inner circumferential surface of the winding portion and the inner core portion.

3. The reactor according to claim 1, wherein the through hole is provided as a single through hole.

4. The reactor according to claim 1, wherein the coil includes a pair of winding portions that are arranged side by side, and when a position between one of the winding portions and the other of the winding portions is defined as a side-by-side middle position, the through hole is provided as a first through hole that is open toward a gap between an area near the side-by-side middle position, of the inner circumferential surface of the one of the winding portions and the inner core portion that is located in the one of the winding portions, and a second through hole that is open toward a gap between an area near the side-by-side middle position, of the inner circumferential surface of the other of the winding portions and the inner core portion that is located in the other of the winding portions.

5. The reactor according to claim 1, wherein a rim of an opening portion of the through hole on the outer side is chamfered.

6. The reactor according to claim 1, wherein at least one of the outer core portion and the inner core portion is made of a powder compact that contains soft magnetic powder.

7. The reactor according to claim 1, wherein at least one of the outer core portion and the inner core portion is made of a composite material that contains resin and soft magnetic powder dispersed in the resin.

8. The reactor according to claim 1, wherein the coil includes an integration resin that is separate from the inner resin portion and integrates turns of the winding portion into one piece.

9. The reactor according to claim 1, further comprising:

an end surface interposed member that is interposed between an end surface of the winding portion in an axial direction and the outer core portion, wherein the end surface interposed member is provided with a resin filling hole that is used to fill, from the outer side, an internal space of the winding portion with resin that constitutes the inner resin portion.

10. The reactor according to claim 9, further comprising:

an outer resin portion that integrates the outer core portion with the end surface interposed member, wherein the outer resin portion and the inner resin portion are connected to each other via the resin filling hole.

11. The reactor according to claim 1, wherein the inner core portion includes a plurality of divisional cores and the inner resin portion that fills gaps between the divisional cores.

12. The reactor according to claim 11, further comprising:

an inner interposed member that is interposed between the inner circumferential surface of the winding portion and the outer circumferential surface of the inner core portion, wherein the inner interposed member includes a plurality of divisional pieces that separate the divisional cores from each other.

13. A method for manufacturing a reactor, the method comprising a filling step that is a step of filling, with resin, a gap between a winding portion that is included in a coil and a magnetic core that is located inside and outside the winding portion to form a closed magnetic circuit, wherein the reactor is the reactor according to claim 1, and in the filling step, a gap between the inner circumferential surface of the winding portion and the outer circumferential surface of the inner core portion is filled with the resin from the outer side of the outer core portion via the through hole provided in the outer core portion.

* * * * *